United States Patent [19]

Street

[11] Patent Number: 4,668,562

[45] Date of Patent: May 26, 1987

[54] VACUUM BONDED NON-WOVEN BATT

[75] Inventor: Robert L. Street, Rock Hill, S.C.

[73] Assignee: Cumulus Fibres, Inc., Charlotte, N.C.

[21] Appl. No.: 852,744

[22] Filed: Apr. 16, 1986

[51] Int. Cl.[4] ..... B32B 7/02

[52] U.S. Cl. ..... 428/218; 5/448; 156/285; 264/517; 264/518; 428/280; 428/282; 428/284; 428/286; 428/287; 428/288; 428/296

[58] Field of Search ..... 428/280, 282, 284, 286, 428/287, 296, 298, 302, 288, 218; 5/448; 156/285; 264/101, 122, 517, 518

[56] References Cited

U.S. PATENT DOCUMENTS

| | | | |
|---|---|---|---|
| 2,483,405 | 10/1944 | Francis | 428/296 |
| 2,500,282 | 3/1950 | Francis | 428/284 |
| 3,088,859 | 5/1963 | Smith | 264/119 |
| 3,510,389 | 5/1970 | Olson et al. | 428/198 |
| 3,616,031 | 10/1971 | Fleissner | 156/306 |
| 4,129,675 | 12/1978 | Scott | 428/288 |
| 4,195,112 | 3/1980 | Sheard et al. | 428/288 |
| 4,297,404 | 10/1981 | Nguyen | 428/218 |
| 4,359,132 | 11/1982 | Parker et al. | 428/288 |
| 4,373,000 | 2/1983 | Knoke et al. | 428/288 |
| 4,377,615 | 3/1983 | Suzuki et al. | 428/213 |
| 4,391,869 | 5/1983 | Cook et al. | 428/218 |
| 4,418,031 | 11/1983 | Doerer et al. | 428/288 |
| 4,474,846 | 10/1984 | Doerer et al. | 428/288 |
| 4,477,515 | 10/1984 | Masuda et al. | 428/288 |
| 4,490,427 | 12/1984 | Grant et al. | 428/288 |
| 4,518,642 | 5/1985 | Johnston et al. | 428/288 |
| 4,532,099 | 7/1985 | Kaji | 156/285 |
| 4,542,060 | 9/1985 | Yoshida et al. | 428/284 |
| 4,568,581 | 2/1986 | Peoples | 428/296 |

*Primary Examiner*—James J. Bell

*Attorney, Agent, or Firm*—W. Thad Adams, III

[57] ABSTRACT

A dense, resilient, non-woven staple polymer fiber batt is formed of either of a plurality of overlayed, relatively thin webs or at least one relatively thick web. The web or webs comprise at least first and second staple polymer fiber constituents blended to form a homogenous mixture. The first fiber constituent has a relatively low melting temperature and the second fiber constituent has a relatively high melting temperature. The fibers of the first fiber constituent are fused by heat to themselves and to fibers of a second fiber constituent to interconnect the fibers while in a vacuum-compressed state. The heat is sufficient to melt the fibers of the first fiber constituent but not high enough to melt the fibers of the second fiber constituent. Therefore, the fibers of the first fiber constituent retain a plastic memory of the batt in its compressed state to hold the interconnected web layers together at the compressed thickness of the batt, and the fibers of the second fiber constituent retain the plastic memory of the fibers in their non-compressed state to provide substantial resilience.

6 Claims, 11 Drawing Figures

VACUUM BONDED NON-WOVEN BATT

TECHNICAL FIELD AND BACKGROUND OF THE INVENTION

This invention relates to a vacuum bonded non-woven batt. The batt is characterized by having a relatively high density which renders it suitable for uses such as mattresses, furniture upholstery and similar applications where substantial density and resistance against compression is desired, together with substantial resilience which will return the batt to its shape and thickness after compression for an indefinite number of cycles.

There are a number of advantages to be achieved by construction of batts for use as mattresses and upholstery from synthetic, staple fiber material. Such fibers are inherently lightweight and therefore easy to ship, store and manipulate during fabrication. These fibers are also generally less moisture absorbent than natural fibers such as cotton, or cellulosic based synthetic fibers such as rayon. Therefore, products made from these fibers can be maintained in a more hygienic condition and dried with much less expenditure of energy. Many such fibers also tend to melt and drip rather than burn. While some of these fibers give off toxic fumes, the escape of such fumes can be avoided or minimized by encapsulating the batt in a fire retardant or relatively air impermeable casing. In contrast, fibers such as cotton burn rapidly at high heat and generate dense smoke.

However, synthetic staple fibers also present certain processing difficulties which have heretofore made the construction of a relatively dense non-woven batt from synthetic staple fibers difficult and in some cases impractical. For example, the resiliency inherent in synthetic fibers such as nylon and polyester is caused by the plastic memory which is set into the fiber during manufacture. By plastic memory is meant simply the tendency of a fiber to return to a given shape upon release of an externally applied force. Unless the plastic memory is altered by either elevated temperature or stress beyond the tolerance of the fiber, the plastic memory lasts essentially throughout the life of the fiber. This makes formation of a batt by compressing a much thicker, less dense batt very difficult because of the tendency of the fibers to rebound to their original shape. Such fiber batts can be maintained in a compressed state, but this has sometimes involved the encapsulation of the batt in a cover or container. All of these methods create other problems such as unevenness and eventual deterioration of the batt due to fiber shifting, breakage and breakdown of the mechanical structure which maintains the compressed batt.

Not only are the batts themselves subject to numerous disadvantages, but the manufacturing processes known in the prior art are deficient in numerous respects. For example, insofar as is known all processes compress the batt into its desired density by use of engaging members such as rollers or plates on both sides of the batt. In effect, the batt is heated simultaneously from both sides to the point where its elastic memory is relaxed. However, the batt must then be removed from the rollers, plates or the like which have held the batt in its compressed state. Even with the use of TFE or other similarly coated rollers or plates, sticking is a common problem. In addition, even heating is inherently difficult to obtain since the fibers in contact with the heated metal surfaces are heated almost instantly whereas fibers in the interior of the batt are heated at a much slower rate. If the rollers between which the batt is traveling are heated to the extent necessary to completely relax the plastic memory of the fibers on the interior of the batt, quite often the fibers in intimate contact with the rollers will melt completely or disintegrate. If the rollers are cooled to avoid complete melting of the fibers on the outer surface of the batt, the interior fibers are not heated sufficiently to reset their plastic memory. In this event, the outer fibers are constantly being pushed against from the interior by fibers whose plastic memory is constantly attempting to cause the fibers to reassume their original shape. Attempts to correct this problem have included varying the percentage of fibers having relatively different melting temperatures through the cross-section of the batt or providing fibers on the interior of the batt having a relatively lower temperature at which the elastic memory is relaxed.

SUMMARY OF THE INVENTION

Therefore, it is an object of the invention to provide a vacuum bonded non-woven batt.

It is another object of the present invention to provide a vacuum bonded non-woven batt wherein the fibers of the batt are evenly fused together from the side to the other by heated air.

It is another object of the present invention to provide a vacuum bonded non-woven batt having an even distribution of first and second constituent fibers throughout the batt.

It is yet another object of the invention to provide a vacuum bonded non-woven batt wherein the desired density and thickness of the batt can be maintained without physically compressing the batt between rollers, plates or the like during manufacture.

These and other objects and advantages of the present invention are achieved by providing a dense, resilient, non-woven staple polymer fiber batt comprised either of at least one relatively thick web or a plurality of overlayed, relatively thin webs. In each case, the web or webs comprise at least first and second staple polymer fiber constituents blended to form a homogeneous intermixture of the fibers. The first fiber constituent has a relatively low predetermined melting temperature and the second fiber constituent has a relatively high predetermined melting temperature. The fibers of the first fiber constituent are fused by heat to themselves and to the fibers of the second fiber constituent to intimately interconnect and fuse the fibers within the web layers and each of the web layers to adjacent web layers while the web layers are in a vacuum-compressed state. The heat is sufficient to melt the fibers of the first fiber constituent but not high enough to melt the fibers of the second fiber constituent. Upon cooling, the fibers of the first fiber constituent retain a plastic memory of the batt in its compressed state to hold the web layer or layers at the compressed thickness of the batt. The fibers of the second fiber constituent retain the plastic memory of the fibers in their non-compressed state and thereby provide substantial resilience to the batt in counteracting compressive forces exerted on the batt by the fibers of the first fiber constituent.

In accordance with one embodiment of the invention, the first and second fiber constituents each comprise polyester. The relatively low melting temperature of the first polyester fiber constituent is in the range of from 240° to 300° F. (115°–149° C.).

Also according to a preferred embodiment, the fiber batt has a density before compression of approximately 4 ounces per cubic foot (4 kg/cm) and a density after compression of approximately 20 ounces per cubic foot (20 kg/cm).

According to the same embodiment, the fiber batt may have a fiber mixture wherein the relatively low melting temperature fiber constituent comprises 15 percent by weight of the fiber batt and the other fiber constituent comprises 85 percent by weight of the fiber batt.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
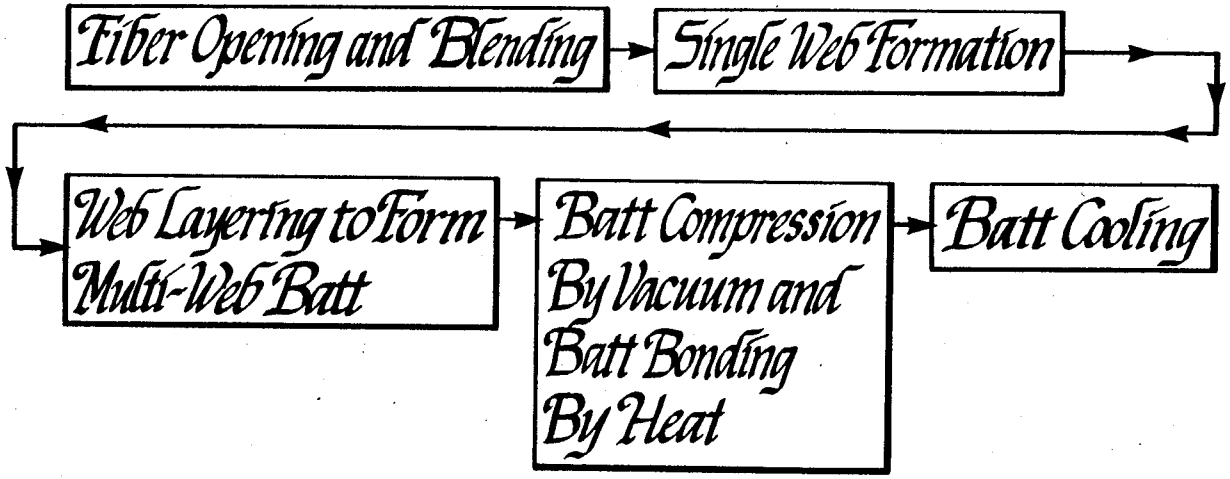
FIG. 1 is a block diagram of a method according to which a fiber batt according to the present invention is constructed.

Referring now specifically to the drawings, a block diagram of the method according to which a batt according to the invention is constructed is shown in FIG. 1. The method begins by opening and blending suitable staple fibers. The stable fibers to be used are chosen from the group defined as thermoplastic polymer fibers such as nylon and polyester. Of course, other thermoplastic fibers can be used depending upon the precise processing limitations imposed and the nature of the compressed batt which is desired at the end of the process. For purposes of this application, the batt is constructed of 85 percent Type 430 15 denier, 3 inch (7.6 cm) staple polyester and 15 percent Type 410 8 denier 2 inch (5 cm) staple polyester, both manufactured by Eastman Fibers. The Type 430 polyester is a conventional polyester fiber which has a melting temperature of approximately 480° F. (294° C.). As used in the specification and claims, this fiber is referred to as having a relatively high predetermined melting temperature as compared with the Type 410 low melt polyester which has a melting temperature of approximately 300° (149° C.).

Low melt polyester of the type referred to above has a melting temperature of approximately 300° F. (149° C.), but begins to soften and become tacky at approximately 240° to 260° F. (115°–127° C.).

As used in this application, however, the term melting does not refer to the actual transformation of the solid polyester into liquid form. Rather, it refers to a gradual transformation of the fiber over range of temperatures within which the polyester becomes sufficiently soft and tacky to cling to other fibers within which it comes in contact, including other fibers having its same characteristics and, as described above, adjacent polyester fibers having a higher melting temperature. It is an inherent characteristic of thermoplastic fibers such as polyester and nylon, that they become sticky and tacky when melted, as that term is used in this application. Also, thermoplastic fibers lose their "plastic memory" when thus heated. The process and apparatus described in this application take advantage of these two simultaneous occurrences by softening and releasing the plastic memory in the fibers having the relatively low melting temperature and causing these fibers to fuse to themselves and to the other polyester fibers in the mat which have not melted and which have not lost their plastic memory.

The opened and blended fiber intermixture is conveyed to a web forming machine such as a garnet machine or other type of web forming machine. As illustrated in this application, the thickness of a single web formed in the web formation step will be approximately $\frac{1}{2}$ to $\frac{3}{4}$ of one inch (1.3–1.9 cm) thick, with a square foot (0.09 $m^2$) piece of the web weighing approximately $\frac{1}{3}$ of an ounce (8.5 gm). However, an air laying machine, such as a Rando webber can be used to form a thick, single layer web structure. Further discussion relates to the multilayer web structure formed by a garnet machine.

Figure 2:
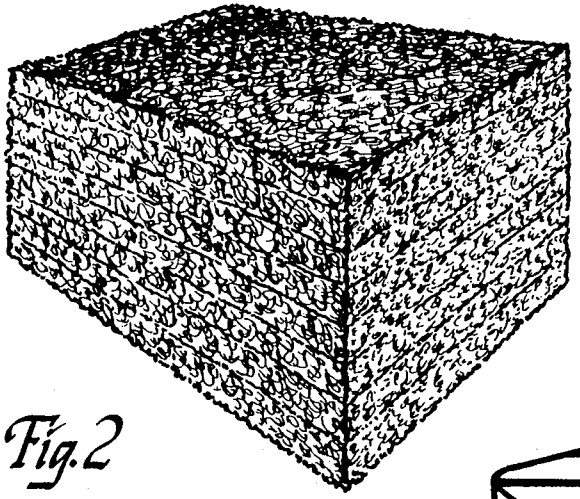
FIG. 2 is a perspective view of a multilayer web structure in its uncompressed state.

Once formed, the web is formed into a multilayer web structure by means of an apparatus which festoons multiple thicknesses of the web onto a moving slat conveyor in progressive overlapping relationship. The number of layers which make up the multilayer web structure is determined by the speed of the slat conveyor in relation to the speed at which successive layers of the web are layered on top of each other. In the examples disclosed below, the number of single webs which make up a multilayer web structure range between 6 and 28, with the speed of the apron conveyor ranging between 27 feet per minute (8.2 m/min) and 6 feet per minute (1.82 m/min). See FIG. 2.

Figure 9:
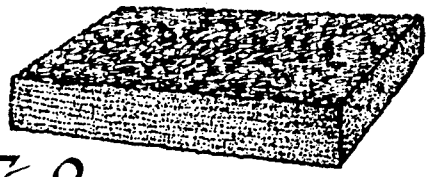
FIG. 9 is a perspective view of a batt according to the invention.

Once the multilayer web structure is formed, it is moved successively onto first and second rotating drums where the web structure batt is simultaneously compressed by vacuum and heated so that the relatively low melting point polyester melts (softens) to the extent necessary to fuse to itself and to the other polyester fibers having a relatively higher melting point. The structure is cooled to reset the plastic memory of the relatively low melting point polyester to form a batt having a density and thickness substantially the same as when the batt was compressed and heated on the rotating drums. See FIG. 9.

Figure 10:
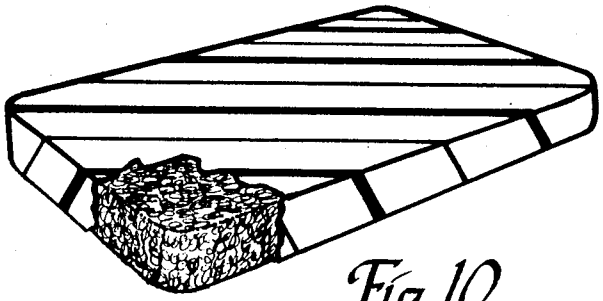
FIG. 10 is a perspective view of a batt in the form of a mattress with mattress cover thereon in accordance with the present invention.

Then, as desired, the batt may be covered with a suitable cover such as mattress ticking or upholstery to form a very dense and resilient cushion-like material. See FIG. 10.

The resulting construction offers substantial advantages over materials of equivalent density such as polyurethane foam. The resulting cushions or mattresses are usable in environments such as aircraft and prisons where a relatively high degree of fire retardency and relatively low output of toxic fumes is desired. Polyester is particularly desirable from this standpoint, since it does not flash-burn and is self-extinguishing. When fully melted to liquid state, polyester drops off when exposed to flame or rolls, with a black, waxy edge forming along the effected area. By enclosing the entire batt within a cover, a much safer product than either foam or cotton is achieved.

Figure 3:
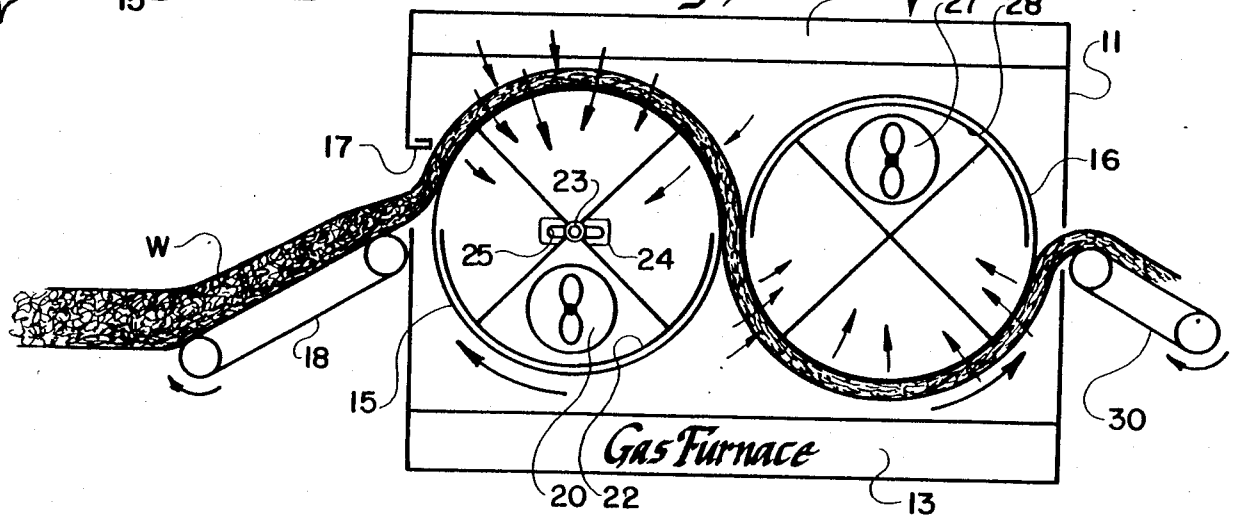
FIG. 3 is a fragmentary side elevational view of an apparatus according to which a fiber batt according to the present invention is constructed.

Referring now to FIG. 3, an apparatus 10 according to the invention by which the method described above may be carried out is shown. Apparatus 10 includes a large substantially rectangular sheet metal housing 11, the upper extent of which comprises an air recirculation chamber. A one million BTU (252,000 kg-cal) gas furnace 13 is positioned in the lower portion of housing 11. Upward movement of the heated air from gas furnace 13 through the housing provides the heat necessary to soften and melt the polyester.

Figure 8:
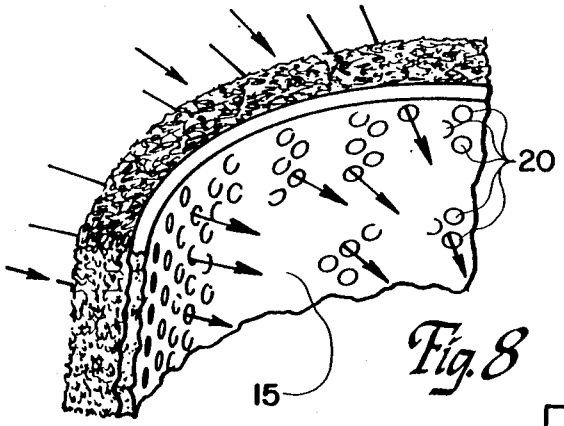
FIG. 8 is an enlarged, fragmentary perspective view showing the perforated surface of one of the drums with the vacuum-compressed multilayer web structure in position thereon.

Two counter-rotating drums 15 and 16, respectively, are positioned in the central portion of housing 11. Drum 15 is positioned adjacent an inlet 17 through which the multilayer web structure W is fed. The web structure is delivered from the upstream processes described above by means of a feed apron 18 through inlet 17. Drum 15 is approximately 55 inches (140 cm) in diameter and is perforated with a multiplicity of holes 20 (see FIG. 8) in the surface to permit the flow of heated air.

In the embodiment illustrated in this application, the drum has thirty holes per square inch (4.7 per sq.cm) with each hole 20 having a diameter of three thirty-seconds of an inch (2.4 mm).

A suction fan 21 preferably having a diameter of 42 inches (107 cm) is positioned in communication with the interior of drum 15. As is also shown by continued reference to FIG. 3, the lower one half of the circumference of drum 15 is shielded by an imperforate baffle 22 so positioned inside drum 15 that suction-creating air flow is forced to enter drum 15 through the holes 20 in the upper half.

Drum 15 is also mounted for lateral sliding movement relative to drum 16 by means of a shaft 23 mounted in a collar 24 having an elongate opening 25. Once adjusted, shaft 23 can be locked in any given position within collar 24 by any conventional means such as a locking pillow block or the like. (Not shown).

Drum 16 is mounted immediately downstream from drum 15 in housing 11. Drum 16 includes a ventilation fan 27, also having a diameter of 42 inches (107 cm). Note that fans 21 and 27 are shown in FIG. 3 in reduced size for clarity. An imperforate baffle 28 positioned inside drum 16 and enclosing the upper half of the circumference of drum 16 forces suction creating air flow to flow through the holes 20 in the lower half of the drum surface.

Preferably, the drum 16 contains the same number and size holes 20 as described above with reference to drum 15. The exiting batt is simultaneously cooled and carried away from housing 11 by a feed apron 30.

Figure 4:
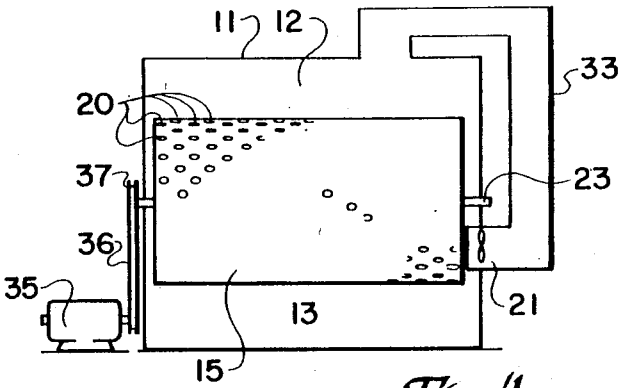
FIG. 4 is a fragmentary end elevational view showing one of the rotating drums shown in FIG. 3 with associated drive and vacuum components.
Figure 11:
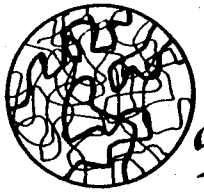
FIG. 11 is a magnified section in a single plane of the fiber structure of a batt according to the present invention.

Both drums are ventilated and driven in the manner shown in FIG. 4. As is shown specifically with reference to drum 15, fan 21 recirculates heated air back to the ventilation chamber of 12 of housing 11 by means of a recirculating conduit 33. Drum 15 is driven in a conventional manner by means of an electric motor 35 connected by suitable drive belting 36 to a drive pulley 37.

Referring again to FIG. 3, multilayer web structure W in uncompressed form enters housing 11 through inlet 17. Suction applied through the holes 20 in drum 15 immediately force the web structure W tightly down onto the rotating surface of drum 15 and by air flow through the holes 20 and through the porous web structure. As is apparent, the extent to which compression takes place at this point can be controlled by the suction exerted through drum 15 by fan 21. The air temperature is approximately 325° F. (163° C.).

By continued reference to FIG. 3, it is seen that one side of the mat is in contact with drum 15 along its upper surface. At a point between drum 15 and drum 16, the web is transferred to drum 16 so that the other side of the web is in contact with the surface of drum 16 and the surface which was previously in contact with drum 15 is now spaced-apart from the surface of drum 16. In effect, a reverse flow of air is created. It has been found that an extraordinarily uniform degree of heating takes place by doing this. Therefore, the polyester fibers having a relatively low melting temperature can be melted throughout the thickness of the web without any melting of the polyester fibers having the relatively high melting temperature.

Figure 5:
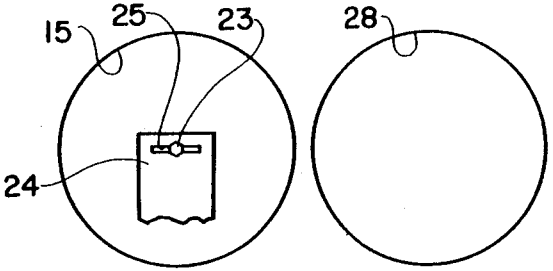
FIG. 5 is a schematic view of the two drums shown in FIGS. 3 and 4 in a given intermediate spaced-apart relation.
Figure 6:
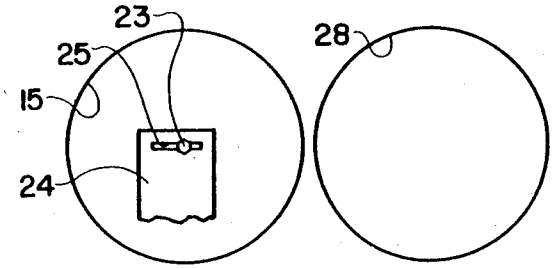
FIG. 6 is a view similar to FIG. 5 showing the two drums in a closer spaced-apart configuration for producing a relatively thinner batt.
Figure 7:
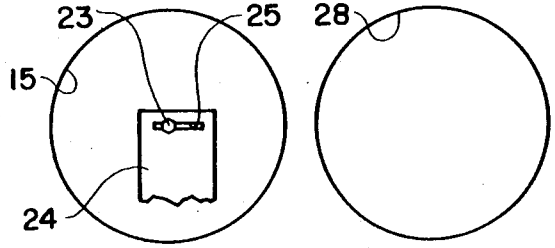
FIG. 7 is a view similar to FIG. 5 showing the two drums in a relatively further spaced-apart configuration for producing a relatively thicker batt.

In order to maintain constant vacuum pressure on the web throughout the housing, it is important that intimate contact between the web structure and either drum 15 or 16 be maintained at all times. To do this, it is important that a gap not be created at the point of transfer of the web structure between drum 15 and drum 16. For example, if the space between the adjacent surfaces of drum 15 and 16 was 5 inches (12.7 cm) and the thickness of the web being transferred at that point was only 3 inches (7.6 cm), a relatively thin length of drum surface on both drums 15 and 16 would be exposed to the free flow of air therethrough. The unrestricted flow of air could damage the web structure. Furthermore, vacuum would not be exerted on the web for a portion of the distance between drum 15 and 16, thereby allowing the polyester fibers having the relatively high melting temperature and which still retain their plastic memory to begin to resume their uncompressed state. This would cause undesirable movement between the softened low melt polyester fibers and the adjacent polyester fibers having the higher melting temperature. Therefore, shaft 23 is adjusted in opening 24 as is illustrated in FIGS. 5, 6 and 7. The adjustment is made according to the thickness of the web being processed so that the distance between adjacent surfaces of drum 15 and 16 very closely approximate the thickness of the web in its compressed state as it is transferred from drum 15 to drum 16.

Assuming a web thickness of 4 inches (10 cm) in its compressed state on drum 15, the distance between adjacent surfaces of drums 15 and 16 in FIG. 5 would be 4 inches (10 cm). To manufacture a web having less thickness, drums 15 and 16 would be moved closer together by sliding shaft 23 forward in opening 24 so that, for example, the distance between drums 15 and 16 would be 2 inches (5 cm) when processing a 2 inch (5 cm) web. Conversely, to process a thicker web, shaft 23 would be moved rearwardly in opening 24 thereby moving drum 15 away from drum 16 so that, again, the thickness of the distance between adjacent surfaces of drums 15 and 16 closely approximates the thickness of the web in its compressed state. It is important to note that the web structure is *not* being compressed by the adjacent drum surfaces at this point. Compression continues to occur only because of vacuum pressure.

As noted above, a wide variety of high density batts can be created by altering the manufacturing of variables in many different ways. In the table that follows, only a few of the many possible processing combinations are illustrated. In the following examples, note the dramatic increase in air flow consistent with the decrease in the input web thickness even though lower fan rpms are needed.

TABLE I

| FINISHED PRODUCT DENSITY oz/ft$^3$ & (kg/m$^3$) | FINISHED PRODUCT THICKNESS inches (cm) | INPUT WEB THICKNESS inches (cm) | NO. OF LAYERS | TOTAL FAN CAPACITY CFM (M$^3$/sec) | FAN RPM | APRON SPEED ft/min (m/min) | AIR TEMP. °F. (°C.) |
|---|---|---|---|---|---|---|---|
| 22.2 | 4.4 (11) | 20 (51) | 28 | 5,000 (2.36) | 800 | 6.0 (1.82) | 325 (163) |
| 24 | 3.5 (8.9) | 18.5 (47) | 26 | 4,800 (2.26) | 850 | 6.5 (1.98) | " |
| 20 | 3.0 (7.6) | 13.5 (34) | 18 | 7,500 (3.54) | 700 | 9.0 (2.74) | " |
| 19 | 2.0 (5.1) | 9.0 (23) | 12 | 8,000 (3.78) | 600 | 13.0 (3.96) | " |
| 20 | 1.0 (2.5) | 5.0 (13) | 6 | 10,000 (4.72) | 550 | 27.0 (8.2) | " |

Once the batt leaves housing 11 it cools very rapidly into a dense batt having the same thickness as when processed in housing 11. Cooling resets the plastic memory of the low melt polyester fibers, fusing the low melt polyester fibers to themselves and also to the fibers having the relatively higher melting temperature. Because of the compression created by the vacuum, many fibers from adjacent web layers fuse to each other. The result is a homogeneous structure which, from visual observation, does not appear to have been constructed from a plurality of thinner layers. (See FIG. 9). The batt processed on the apparatus and according to the method described above therefore has fibers with plastic memories set at two different temperatures. The plastic memory of the low melting point fibers act as springs to pull the batt into a compressed state. The plastic memory of the fibers having the higher melting temperature urge the batt to expand but are prevented from doing so by the low melt fibers. The result is a batt which, while being held in a relatively dense, compressed state nevertheless has considerable resiliency.

A vacuum bonded non-woven batt is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A dense, resilient, non-woven staple polymer fiber batt comprising a plurality of overlayed, relatively thin webs, each of said webs comprising at least first and second staple polymer fiber constituents blended to form a homogeneous intermixture of said fibers, predetermined melting temperature and said second fiber constituent having a relatively high predetermined melting temperature, the fibers of said first fiber constituent being fused by heat to themselves and to the fibers of said second fiber constituent to intimately interconnect and fuse the fibers within the web layers and each of said web layers to adjacent web layers while said web layers are in a vacuum-compressed state, said heat being sufficient to melt the fibers of the first fiber constituent but not high enough to melt the fibers of the second fiber constituent whereby, upon cooling, the fibers of the first fiber constituent retain a plastic memory of the batt in its compressed state to hold the interconnected web layers together at the compressed thickness of the batt, and the fibers of the second fiber constituent retain the plastic memory of said fibers in their non-compressed state and thereby provide substantial resilience to said batt in counteracting compressive forces exerted on said batt by the the fibers of the first fiber constituent.

2. A dense, resilient, non-woven staple polymer fiber batt comprising at least one relatively thick web, said web comprising at least first and second staple polymer fiber constituents blended to form a homogeneous intermixture of said fibers, said first fiber constituent having a relatively low predetermined melting temperature and said second fiber constituent having a relatively high predetermined melting temperature, the fibers of said first fiber constituent being fused by heat to themselves and to the fibers of said second fiber constituent to intimately interconnect and fuse the fibers within the web while said web is in a vacuum-compressed state, said heat being sufficient to melt the fibers of the first fiber constituent but not high enough to melt the fibers of the second fiber constituent whereby, upon cooling, the fibers of the first fiber constituent retain a plastic memory of the batt in its compressed state to hold the web at the compressed thickness of the batt, and the fibers of the second fiber constituent retain the plastic memory of said fibers in their non-compressed state and thereby provide substantial resilience to said batt in counteracting compressive forces exerted on said batt by the the fibers of the first fiber constituent.

3. A fiber batt according to claim 1 or 2, wherein said first and second fiber constituents each comprise polyester and the relatively low melting temperature of the first polyester fiber constituent is in the range of from 240 to 300 degrees F. (115°–149° C.).

4. A fiber batt according to claim 3 and having a density before compression of approximately 4 ounces per cubic foot (4 kg/m$^3$) and a density after compression of approximately 20 ounces per cubic foot (20 kg/m$^3$).

5. A fiber batt according to claim 1 or 2, wherein said first fiber constituent comprises 15 percent by weight of said fiber batt and said second fiber constituent comprises 85 percent by weight of said fiber batt.

6. A fiber batt according to claim 3, wherein said first fiber constituent comprises 15 denier, 2 inch (5 cm) staple polyester and said second fiber constituent comprises 15 denier, 3 inch (7.6 cm) staple polyester.

* * * * *

UNITED STATES PATENT AND TRADEMARK OFFICE

CERTIFICATE OF CORRECTION

PATENT NO. : 4,668,562

DATED : May 26, 1987

INVENTOR(S) : Robert L. Street

It is certified that error appears in the above-identified patent and that said Letters Patent are hereby corrected as shown below:

Column 3, line 60, correct "stable" to read --staple--.

Column 7, line 65, after the words "of said fibers," insert --said first fiber constituent having a relatively low--.

Signed and Sealed this

Fifteenth Day of September, 1987

*Attest:*

DONALD J. QUIGG

*Attesting Officer*

*Commissioner of Patents and Trademarks*